US005188134A

United States Patent [19]

Satoh et al.

[11] Patent Number: 5,188,134

[45] Date of Patent: Feb. 23, 1993

[54] AUTOMATIC INNER PIPELINE SURFACE WASHING APPARATUS

[75] Inventors: Katsuhiko Satoh, Kawanishi; Itsuo Muto, Shijyonawate; Shigeki Takeda, Takaishi; Mamoru Miyamoto, Itami, all of Japan

[73] Assignees: Kabushiki Kaisha POWREX; Kabushiki Kaisha Arikawa Seisakusho, both of Japan

[21] Appl. No.: 757,397

[22] Filed: Sep. 10, 1991

[30] Foreign Application Priority Data

Jun. 21, 1991 [JP] Japan ..... 3-149113

[51] Int. Cl.[5] ..... B08B 9/04

[52] U.S. Cl. ..... 134/57 R; 4/255.06; 134/167 C; 137/240; 251/5

[58] Field of Search ..... 134/167 C, 168 C, 113, 134/56 R, 57 R; 4/255, 256; 137/240; 251/5

[56] References Cited

U.S. PATENT DOCUMENTS 3,075,535 1/1963 Lasting ..... 134/167 C
3,526,547 9/1970 Shock ..... 4/256 X
3,872,521 3/1975 Friedman ..... 4/255
4,546,789 10/1985 Taylor ..... 4/255 X
4,643,218 2/1987 Reed, Jr. ..... 134/167 C X
4,981,150 1/1991 Francis et al. ..... 134/167 C X

*Primary Examiner*—Philip R. Coe
*Attorney, Agent, or Firm*—Nikaido, Marmelstein, Murray & Oram

[57] ABSTRACT

Each of the washing units A and B comprises an openable and closable pinch valve unit 4 branchwise connected to a pipeline C, an autofeeder unit 5 for controlling the feed for advance and retraction movement of a high pressure hose 6 having rotatable nozzle unit connected to the front end thereof, and a hose reel unit 7 for winding and unwinding the high pressure hose. During washing operation, the nozzle unit enters the pipeline C through the pinch valve unit 4 now opened to wash the inner surface of the pipeline. During nonwashing period, the nozzle unit is moved rearward and completely isolated from the pipeline by the pinch valve unit 4 now closed. Therefore, the washing units A and B are completely separated from the pipeline C during nonwashing period.

4 Claims, 8 Drawing Sheets

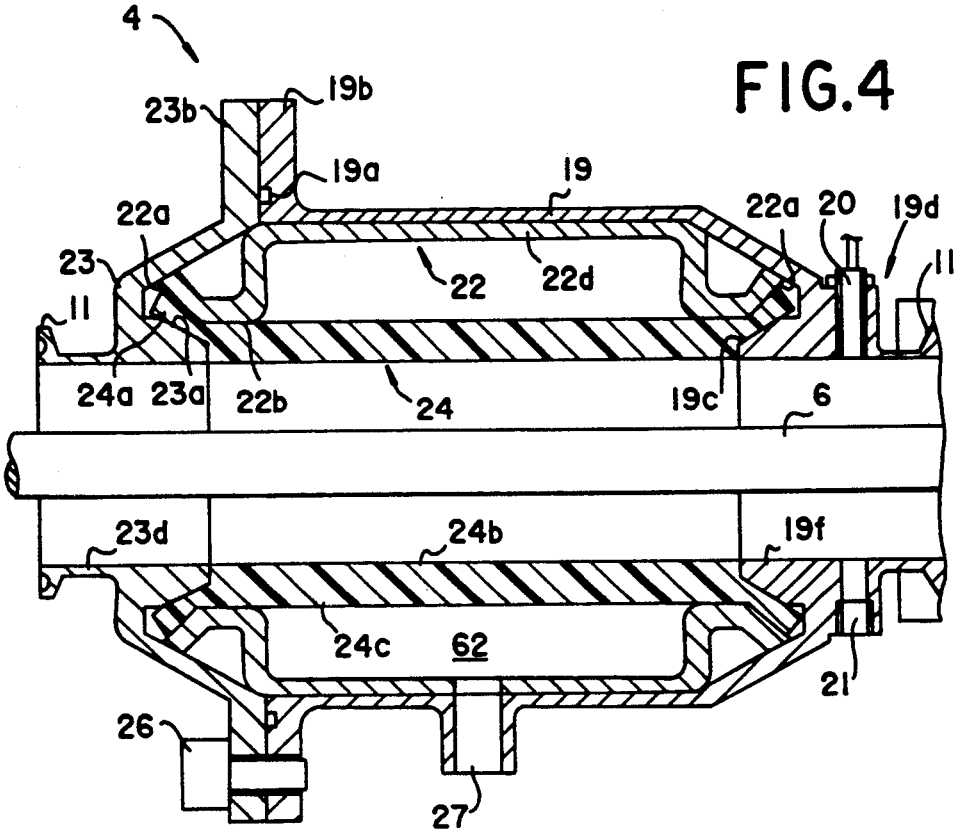
FIG.4
FIG.6
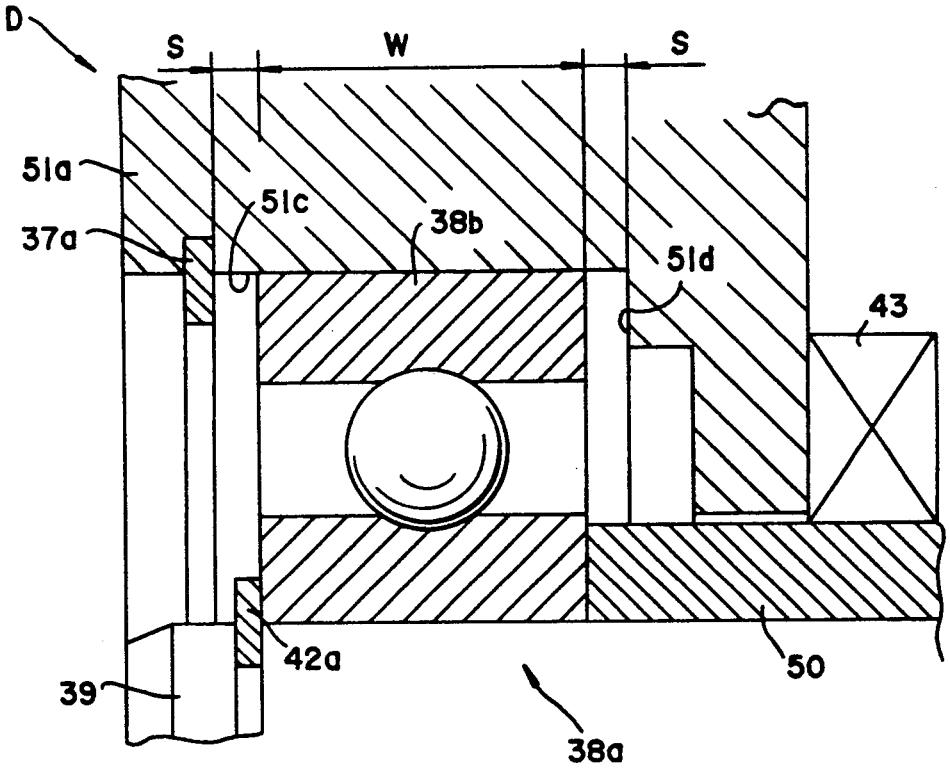

AUTOMATIC INNER PIPELINE SURFACE WASHING APPARATUS

BACKGROUND OF THE INVENTION

The present invention relates to an automatic inner pipeline surface washing apparatus and particularly to an apparatus for automatically washing the piping in a drug, food or the like producing plant in response to external settings, such as, optimum washing feed rate and the number of repetitions of washing.

Among the conventional washing apparatuses of this type are one having a nozzle formed with a plurality of spout holes for spouting high pressure water rearwardly of the inner pipeline surface, the spouting force producing a thrust in the nozzle to cause the latter to wash the inner pipeline surface while moving forward and another having a high pressure hose adapted to be rotated by a high pressure hose rotating terminal unit or by a driving device while being fed to the inner pipeline surface to wash the inner pipeline surface.

In the conventional apparatuses, during washing in the direction of forward movement, the longer the high pressure hose and the greater the number of bends in the pipeline and longer the vertical portion of the pipeline, the greater and more indefinite the resistance to the slide movement between the high pressure hose and the inner pipeline surface. As a result, the traveling speed of the nozzle in the pipeline becomes indefinite throughout the pipeline, producing a variation in washing rate or making the traveling feed impossible.

Further, in the case of washing in the retracting direction, there has been no alternative but to manually pull back the hose.

On the other hand, in the case of washing with the high pressure hose kept rotating, as in the above, since the torque from the high pressure hose rotating terminal unit or driving device is transmitted through the high pressure hose concurrently with creation of an increase and variation in the torque due to the slide resistance, it is not correctly transmitted to the front end of the nozzle, producing a variation in rotation.

Further, since the high pressure hose rotating terminal unit or driving device is complicated in construction, the entire apparatus becomes large-sized and expensive.

Further, the greatest drawback of these conventional apparatuses is that the nozzle is attached inside the pipeline, which is an object to be washed, in its projecting state. Thus, in the case of treating powder or the like in the pipeline, the nozzle gets clogged with powder particles, becoming unable to rotate to wash during the washing operation, and a closing or adhering phenomenon of powder due to the washing nozzle takes place, making stabilized operation of the apparatus impossible. Further, in some cases, a decrease in productivity or quality of products takes place.

For the reasons described above, the conventional common method of washing the interior of a pipeline or the like has been either to open a washing port by hand and then insert a washing nozzle or hose therein for washing or to disassemble and then normally wash various parts. Therefore, in the case where the number of places to be washed is increased or washing is to be effected in a location of difficult access, not only are much labor and time required but also the operation is dangerous, resulting in an increase in the washing cost and forming a cause of a variation in the washing effect or quality. Further, personal mistakes tend to occur and in a plant for producing drugs, food or the like, it becomes difficult to minimize contamination of or change in quality of drugs, food or the like. To solve these problems, it may be contemplated to make a program of washing cycles (for example, (1) primary washing with tap water (washing with a detergent), (2) washing finish using deionized water or distilled water, (3) hot air drying) and washing conditions (for example, (1) washing pressure, (2) washing temperature, (3) washing time or amount of water, (4) hot air temperature, hot air drying time) so as to effect sequential control. Reversely, this has hindered full automation of a washing system which is expected to contribute much to labor saving and increased productivity.

Accordingly, an object of the present invention is to provide means for solving the above problems found in the conventional washing apparatuses.

SUMMARY OF THE INVENTION

A first form of the invention provides a automatic inner pipeline surface washing apparatus having a washing hose having connected at its front end a pinch valve unit which can be opened and closed and is branchwise connected to a pipeline to be washed, an autofeeder unit connected to said pinch valve unit, a rotation type nozzle unit adapted to spout a washing liquid circumferentially rearward while rotating, and a nozzle unit. The washing hose is controlled for advance and retraction with a predetermined thrust and speed by the autofeeder unit, and at the time of washing, the nozzle unit enters the pipeline through the pinch valve unit and washes the inner pipeline surface while spouting the washing fluid feed through the washing hose and during nonwashing period, the nozzle is retracted and is completely isolated from the pipeline by the closed pinch valve.

In a second form of the invention, the autofeeder unit is provided with a torque limiter unit for controlling the thrust on the washing hose.

In third form of the invention, there is installed a detection unit for detecting the origin position and advance terminal position of the washing hose, the detection signals from the detection unit being fed to a control device for variable speed control of the autofeeder unit to automatically control the advance and retraction of the washing hose.

In a fourth form of the invention, there is installed a hose reel unit which undergoes forward and backward variable speed rotation control for winding and unwinding the washing hose, said hose reel unit being connected to washing fluid pumping means to feed the washing fluid to the washing hose through the hose reel unit.

In a fifth form of the invention, a pair of automatic washing apparatuses are branchwise connected a pipeline between upstream and downstream machines, wherein one automatic washing apparatus connected to a portion of the pipeline adjacent the upstream machine and adapted to wash the portion of the pipeline extending to the downstream machine and also wash the downstream machine and the other automatic washing machine connected to a portion of the pipeline adjacent the downstream machine and adapted to wash the portion of the pipeline extending to the upstream machine and also wash the upstream machine are selectively operated under control.

The washing hose is feed-controlled for advance and retraction with a predetermined thrust and speed by the autofeeder unit. The washing hose has the nozzle unit connected to the front end thereof, said nozzle unit being adapted to enter a pipeline through a opened pinch valve unit in response to the advance movement of the washing hose. The nozzle unit entering the pipeline is advanced and retracted in the pipeline in response to the advance and retraction feed of the washing hose. Upon completion of washing, the washing hose is retracted by the autofeeder unit and in response thereto and with this retraction, the nozzle unit is retracted in the pipeline, moving rearward through the pinch valve. And the pinch valve unit is closed. The washing apparatus system is completely separated from the pipeline by the pinch valve unit.

Since the automatic washing apparatus of the invention can be completely separated from the pipeline, clogging of the nozzle or a closing or adhering phenomenon of powder due to the nozzle does not take place. Furthermore, since the apparatus is connected directly to the pipeline, such operations as transport operation of power A, washing operation, and transport operation of powder B can be effected continuously and automatically in the closed state without disassembling the apparatus and machines. The invention has the following particular merits.

(1) During nonoperation, the nozzle unit is not projecting to the inner surface of the connecting portion of the apparatus and the pinch valve unit closes the connecting portion of the apparatus and separates it completely from the pipeline; therefore, even if treatment of powder is effected, there is no hindrance to the movement of powder and contamination and other problems can be avoided.

(2) Even if a pipeline which is an object to be washed has 2–3 or more bends and even if the slide resistance between the high pressure hose and the inner pipeline surface is increased or indefinite, the nozzle unit can be advanced or retracted along the bends of the pipeline at a constant speed and with a constant thrust.

(3) In the case where the nozzle unit becomes unable to move due to the presence of places on the inner surface of the pipeline which are closed with a material to be transported, a slippage takes place between the torque limiter mounted on the autofeeder unit and the feed rollers, preventing the torque of the motor from being transmitted to the high pressure hose. Thus, since the high pressure hose is instantly stopped, it is protected against bending or damage.

(4) The employment of the rotatable nozzle dispenses with the use of a terminal device or driving device for imparting a torque to the nozzle. As a result, the entire apparatus becomes simplified in construction, decreased in size and inexpensive. Further, since the nozzle unit is rotated while spouting a washing fluid, washing in all directions of 360 degrees is possible.

(5) Constructing the washing system having a pair of washing devices connected to the pipeline decreased the size of the entire apparatus, and automatic operation makes it possible to wash even a place of difficult access to the operator.

(6) By making a program of the configuration of pipelines, washing cycles, washing conditions, the required number of times of washing, etc. and by automatically alternately effecting washing by the washing apparatus on the downstream side and the washing apparatus on the upstream side, there will be no place left unwashed and a washing effect at a fixed level can be obtained.

(7) If SUS, Teflon or the like is used as the material for the portions in contact with the liquid, high temperature water, almost boiling, which has been dangerous for the conventional manual washing, can now be used; thus, the washing effect is high.

(8) Since purging with high temperature compressed air is allowed, purging at a suitable pressure can be effected upon completion of washing, thereby preventing the washing fluid from flowing in during the operation of the washing apparatus and making it possible to quickly dry the interior of the pipeline after washing.

BRIEF DESCRIPTION OF THE DRAWINGS

FIG. 4 is a sectional view showing the open state of the pinch valve unit;

FIG. 6 is an enlarged sectional view showing the portion D in FIG. 5;

DESCRIPTION OF THE PREFERRED EMBODIMENTS

Embodiments of the invention will now be described with reference to the drawings.

Figure 1:
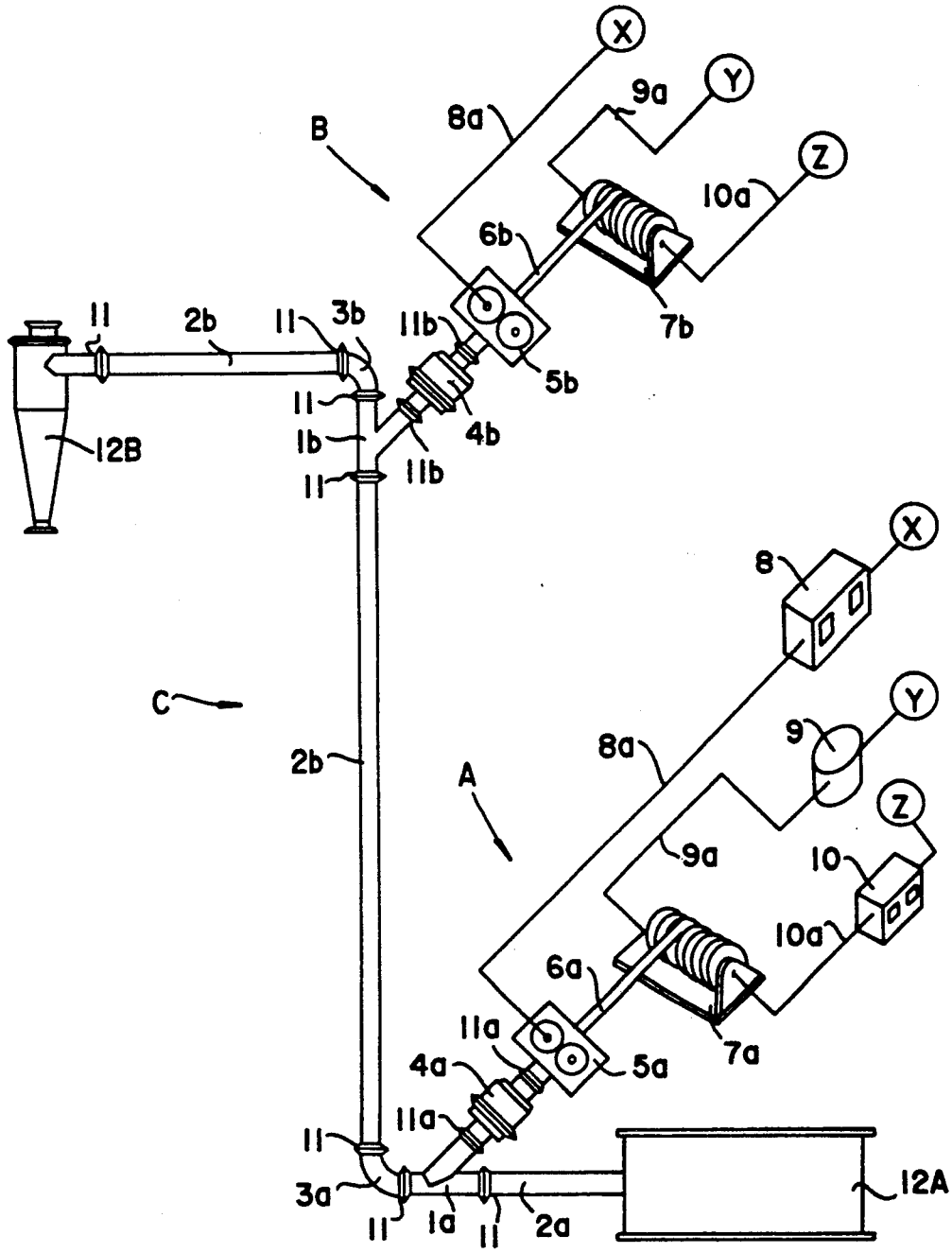
FIG. 1 is a view showing the entire arrangement of an automatic washing apparatus according to the invention.

FIG. 1 shows the entire arrangement of an automatic washing apparatus according to the invention. This automatic washing apparatus comprises a pair of washing units A and B branchwise connected through ferrule joints 11*a* and 11*b* to a pipeline C comprising a downstream machine 12A, a horizontal pipe 2*a*, a Y-shaped pipe joint 1*b*, an elbow 3*a*, a vertical pipe 2*b*, a Y-shaped pipe joint 1*b*, an elbow 3*b*, a horizontal pipe 2*b* and an upstream machine 12B which are connected together through ferrule joints 11. The washing unit A comprises a pinch valve unit 4*a* connected to the Y-shaped pipe joint 1*a* of the pipeline C through the ferrule joint 11*a*, an autofeeder unit 5*a* connected to the pinch valve unit 4*a* through the ferrule joint 11*a*, a high pressure hose 6*a* having a nozzle unit 15 to be later described joined to the front end thereof, and a hose reel unit 7*a* for winding and unwinding the high pressure hose 6*a*. Similarly, the washing unit B comprises a pinch valve unit 4*b*, an autofeeder unit 5*b*, a high pressure hose 6*b* and a hose reel unit 7*b*. The pair of autofeeder units 5*a* and 5*b* are electrically connected to a control panel 8 through a control/power line 8*a*. Further, the pair of hose reel units 7*a* and 7*b* are electrically connected to a control panel 10 through a control/power line 10*a* and are controlled by said control panel 10 for forward and backward rotation at variable speed. The rear end of the high pressure hose 6 is wound on the hose reel unit 7 and is connected to a high pressure pump unit 9 by a high pressure water pipe 9*a* through a rotary joint (not shown) and is fed with a washing fluid, e.g., high temperature high pressure water.

Figure 2:
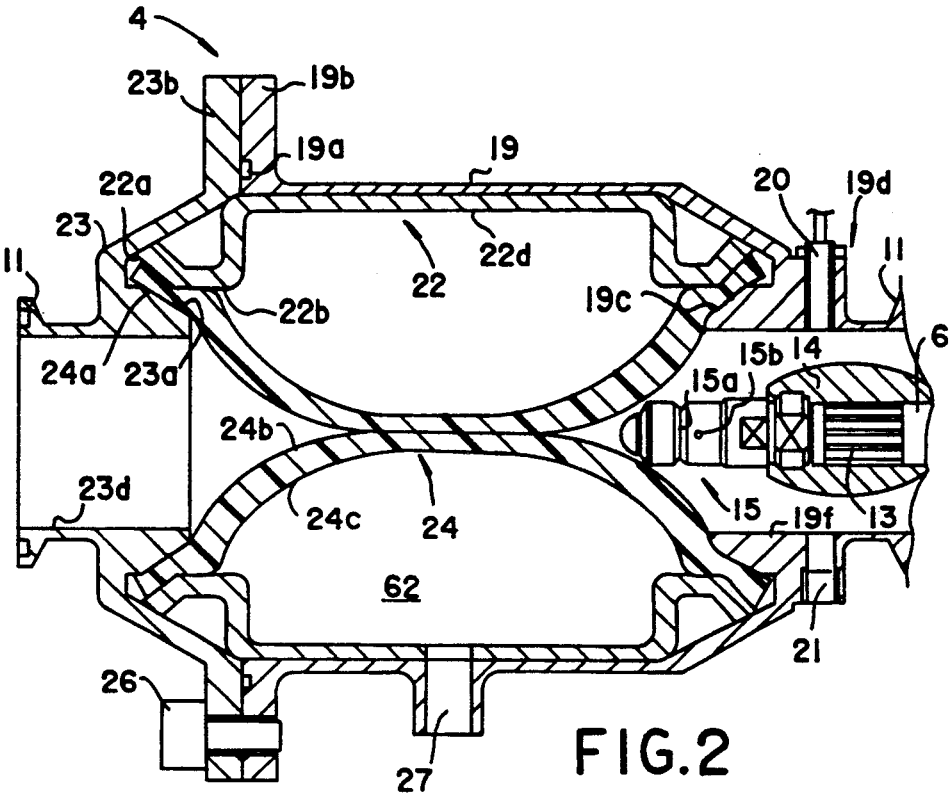
FIG. 2 is a sectional view showing the closed state of a pinch valve unit.

As shown in FIG. 2, a hose thread joint 13 if fixed to the front end of the high pressure hose 6, with a rotation type nozzle unit 15 threadedly fitted on the male threaded portion of the hose thread joint 13. Further, a detecting ring 14 is fixed on the outer periphery of the hose thread joint 13. The nozzle portion of the nozzle unit 15 is formed with a plurality of spout holes 15*a* for spouting the washing fluid obliquely rearward and a single spout hole 15*b* for circumferentially spouting the washing fluid.

Figure 3:
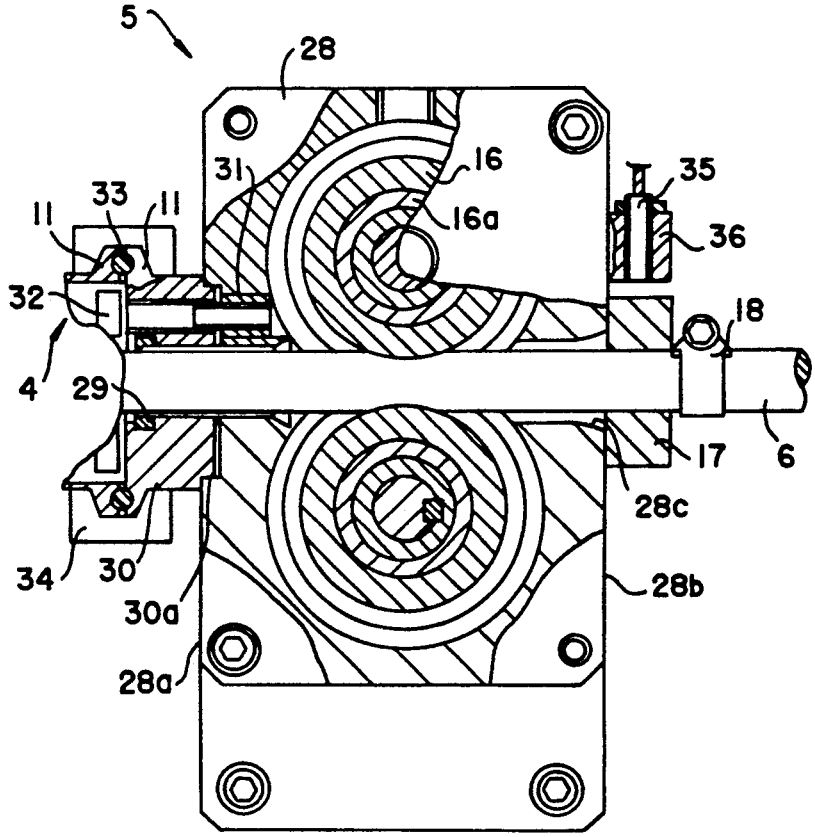
FIG. 3 is a sectional view, partly broken away, showing an autofeeder unit.

As shown in FIG. 3, the high pressure hose 6 is pressed at its intermediate portion uniformly by a fixed amount by a pair of vertically spaced feed rollers 16 with bushings 16*a* built in the autofeeder unit 5. Further, a detecting ring 17 is mounted on the portion of the high pressure hose located rearwardly of the autofeeder 5 and is positioned and held by a stopper ring 18 so that is position corresponds to the required length for washing of the pipeline which is an object to be washed.

As shown in FIGS. 2 and 4, the valve sleeve 19 of the pinch valve unit 4 connected to the autofeeder unit 5 has a flange 19*b* formed at its front portion with an O-ring groove 19*a*, a tapered cylindrical packing compressing surface 19*c* formed at the rear inner surface, a boss 19*d* and a ferrule joint 11 formed rearwardly of the boss 19*d*. A proximity switch 20 is threadedly installed in the upper portion of the boss 19*d*, and the lower portion of said boss is formed with a discharge hole 21 for discharging the washing drain collected in the interior. The proximity switch 20 is connected to the control panel 8 and cooperates with the detecting ring 14 to form an "origin position detecting unit" for the high pressure hose 6. In addition, the discharge hole 21 opens to the atmosphere. An inner ring 22 fitted on the inner surface of the valve sleeve 19 is symmetrical, comprising tapered surfaces 22*a* at its opposite ends, cylindrical surfaces 22*b* continuous with the tapered surfaces 22*a*, and a central cylindrical portion 22*d*. A valve cover 23 comprises a flange 23*b* joined to the flange 19*b* in the rear portion, a tapered packing compressing surface 23*a* on the inner surface, and a ferrule joint 11 on the front end surface projecting like a pipe. A rubber sleeve 24 has tapered cylindrical portions 24*a* at the opposite ends, said tapered cylindrical portions 24*a* being clamped by the packing compressing surface 19*c* and the tapered surface 22*a* and by the packing compressing surface 23*a* and the tapered surface 22*a*. After the rubber sleeve 24 has been installed under pressure in this manner, the flanges 19*b* and 23*b* are joined together by bolts 26 through an O-ring fitted in the O-ring groove 19*a*. In this case, it is preferable that the inner surface 24*b* of the rubber sleeve 24, the inner surface 19*f* of the boss 19 and the inner surface 23*d* of the valve cover 23 be of the same diameter and that their boundary junction surfaces be intimately contacted with each other so that there is neither clearance nor step-like land formed therebetween. Further, the central portion of the inch valve unit 4 is formed with an air feeding and discharging hole 27 extending through the outer valve sleeve 19 and inner ring 22. And an operating air chamber 62 is defined between the inner ring 22 and the rubber sleeve 24.

As shown in FIG. 3, joined to the front end surface 28*a* of the casing 28 of the autofeeder unit 5 is a flange 30 formed at its rear end surfaces with a faucet joint element portion 30*a*. The flange 30 has a scraper 29 fitted in the rear end surface thereof and a ferrule joint 11 formed on the front end surface thereof. After the flange 30 is fitted at its faucet joint element portion 30*a* in the front end surface 28*a*, it is fixed to the casing 28 by bolt sets 32 through auxiliary female threads 31 and then the ferrule joint 11 is joined to the ferrule joint 11 of the pinch valve unit 4 by a clamp joint 34 through a ferrule packing 33. On the other hand, the rear end surface 28*b* of the casing 28 is formed with a tapered surface 28*c* for facilitating the introduction of the high pressure hose 6, and has a bracket 36 fixed thereto, said bracket having a proximity switch 35 threadedly fitted thereto. The proximity switch 35 is connected to the control panel 8 and cooperates with the detecting ring 17 to form a "forward travel terminal position detecting unit".

Figure 5:
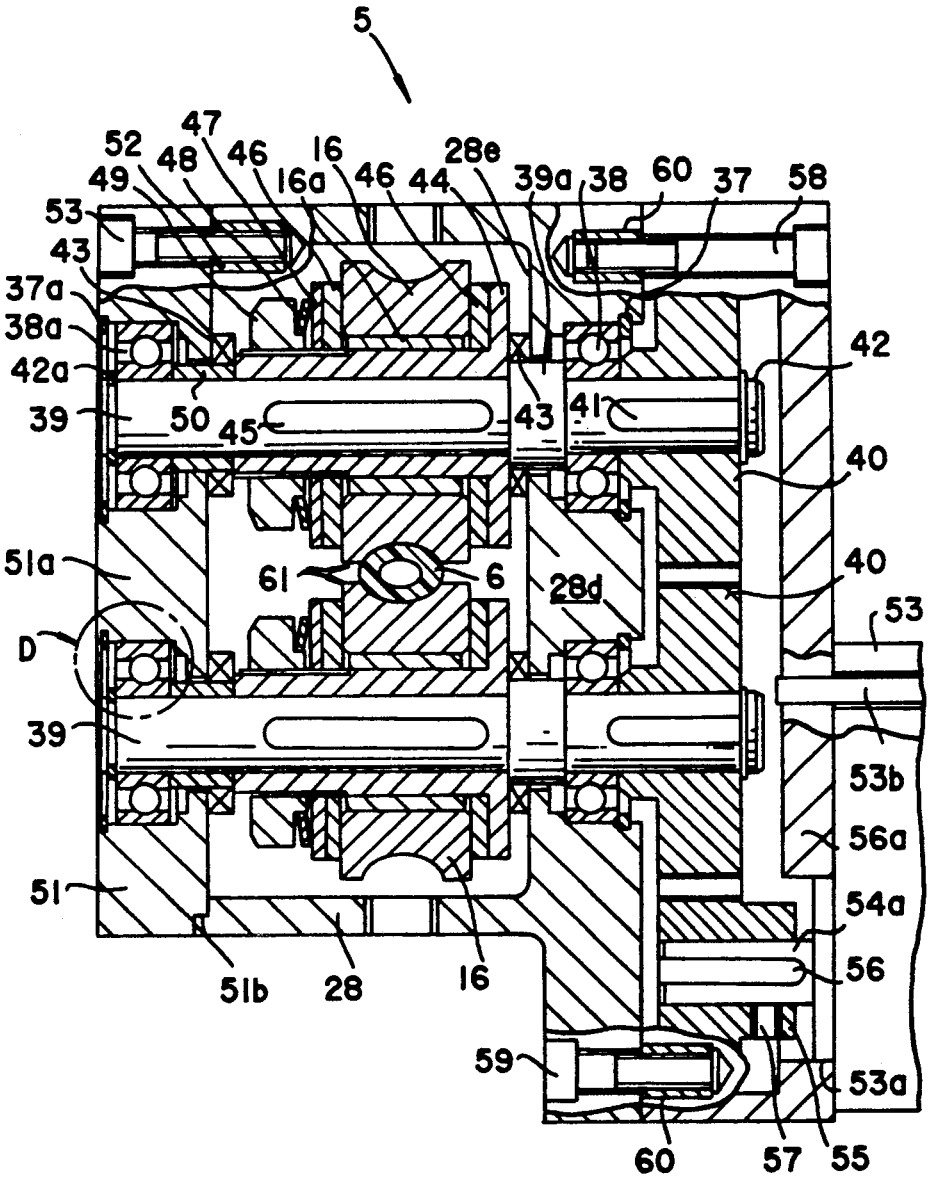
FIG. 5 is a sectional view showing the autofeeder unit.

As shown in FIG. 5, bearings 38 are fixedly fitted in the bearing portion 28*d* of the casing 28 through snap rings 37. A shaft shorter than the step portion 39*a* of a feed roller drive shaft 39 is received in each bearing 38. This shaft has a distribution gear 40 mounted thereon and fixed in position by a key 41 and a snap ring 42. Mounted on the outer surface of the step portion 39*a* is a lip seal 43 in contact with the end surface 28*e* of the bearing portion 28*d* for sealing. Mounted on the portion of the feed roller drive shaft 39 having a greater length as measured from the step portion 39*a* is a single-flanged boss 44 fixed on the feed roller drive shaft 39 by a key 45 and in intimate contact with the step portion 39*a*. Further, a friction plate 46, a feed roller 16 having a bushing 16*a*, a friction plate 16 and a plate 47 are mounted on the single-flanged boss 4 in the order mentioned and are fixed in position by a nut 49 threadedly fitted on the threaded portion of the single-flanged boss 44 through a disc spring 48. The single-flanged boss 44, friction plates 46, plate 47, nut 49 and disc spring 48 cooperate with each other to form a torque limiter unit. Further, a collar 50 is installed in contact with the end surface of the flange-less side of the single-flanged boss 44 and a lip seal 43 is mounted on the outer surface of said collar. In this state, the high pressure hose 6 is passed between the grooves 61 of the pair of vertically spaced feed rollers 16 and held therein for advance and retraction. Then, with the bearing cover 51 loosely fitted at its faucet joint element portion 51*b* in the casing 28, the bearing 38*a* is fitted on the feed roller drive shaft 39 and in the bearing portion 38*a* of the bearing cover 51. And it is fixed in position by a snap ring 42.

As shown in FIG. 6, the outer ring 38*b* of the bearing 38*a* is fitted in the fitting surface 51*c* of the bearing portion 51*a* and limited in axial movement by the snap ring 37*a* and shoulder 51*d*, but the distance between the snap ring 37*a* and the shoulder 51*d* is greater than the bearing width W, so that equal clearances S are defined on the opposite end sides of the outer ring 38*b*.

The autofeeder unit 5 comprises a pair of vertically spaced feed roller units arranged in the manner described above. And the distance between the axes of the shafts is set at the same value as the pitch circle diameter of the distribution gears 40 so that the distribution gears 40 rotatably engaged with each other with a suitable backlash maintained therebetween. Further, the bearing cover 51 is centered at a position where the upper and lower feed rollers rotate most lightly, and then it is fixed to the casing 28 by bolt sets 53 through auxiliary female threads 52.

Figure 7:
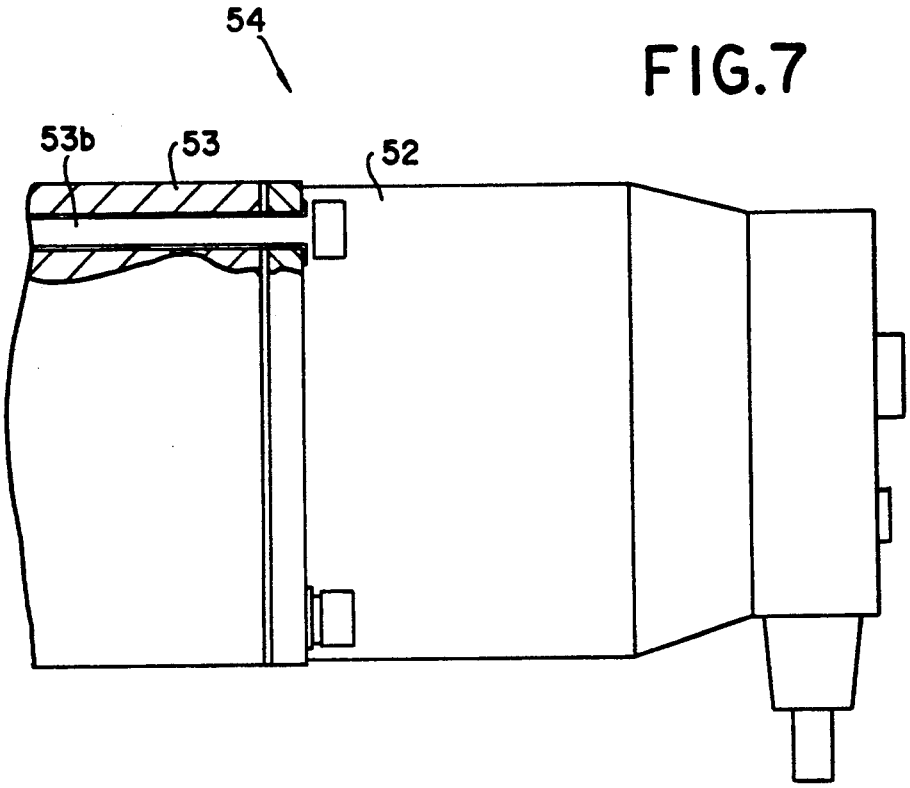
FIG. 7 is a view, partly broken away, showing a driving motor for the autofeeder unit.

As shown in FIG. 7, a drive motor 54 for the autofeeder unit is a geared motor whose motor 52 and gear box 53 are integrated. As shown in FIG. 5, an output shaft 54*a* extending through the gear box 53 has a pinion gear 55 fixed thereto by a key 56 and fixed by a screw 57 in the position where it correctly engages the distribution gear 40. The end surface of the gear box 53 is formed with a faucet joint element portion 53*a* having a slightly greater diameter than the outer diameter of the pinion gear 55. After the faucet joint element portion 53*a* fitted to the motor cover 56*a*, the drive motor 54 is fixed in position by a bolt set 53*b*. After the motor cover 55*a* is centered so that the pinion gear 55 and the distribution gear 40 rotatably mesh with each other with a suitable backlash held therebetween, it is fixed to the casing 28 by bolt sets 53*b* through auxiliary female threads 60. The motor 52*a* is connected to the control panel 8 through the control/power line 8*a* and is controlled by the control panel 8 for forward and backward rotation at variable speed.

Figure 8:
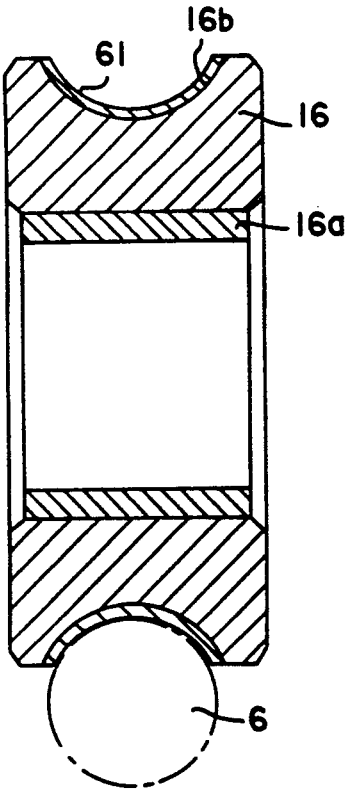
FIG. 8 is a sectional view showing a feed roller.

As shown in FIG. 8, the feed roller 16 is cylindrical, with a bushing 16*a* fitted in the inner surface thereof and is formed at its outer central portion with a groove 61 for gripping the high pressure hose 6. There are a pair of such grooves 61 vertically spaced, adapted to uniformly press the high pressure hose 6, the shape and size thereof being such that there is no slippage between the grooves and the high pressure hose 6.

Figure 9:
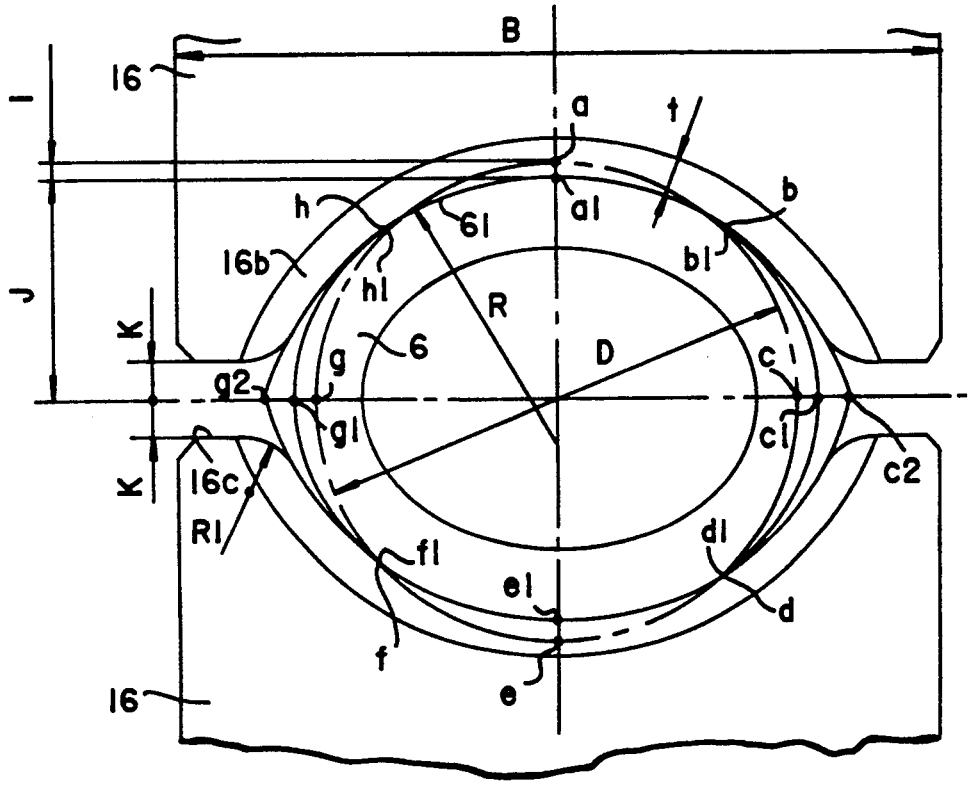
FIG. 9 is a view showing groove shape of the feed roller.

Referring to FIG. 9, the shape of the high pressure hose before pressed by the feed rollers 16 is a circle with a diameter D formed by connecting points a, b, c, d, e, f, g, h and a, but its shape after being pressed is typically an ellipse formed by connecting points a1, b1, c1, d1, e1, f1, g1, h1 and a1. The shape of the groove 61, approximately, is an arc with a radius of curvature R formed by connecting points g2, h1, a1, b1, and c1 or points g2, f1, e1, d1 and c2. The spacing between points b1 and c2, points h1 and g2, points d1 and c2 and points between f1 and g2 are smoothly connected by a cylindrical surface 16*c* defining a roll clearance 2*k*. An example of dimensional relation will be given using reference characters in the figure. If the outer diameter D of the high pressure hose is taken to be 1, then R=0.6–0.9, R1=0.1–0.2, i=0.04–0.08, J=0.5–0.4, K=0.08–0.01, and B=1.9–2.1. Further, in the present embodiment, a rubber elastic body having a JIS rubber hardness of 60–80 was used as the material for forming the feed rollers 16. And the groove 61 is formed with a lining layer 16*b* of silicone rubber to increase the durability during use of washing fluid such as high temperature high pressure water. The thickness t of the lining layer, shown on the same basis, is to=0.04–0.08.

The operation of the washing apparatus arranged in the manner described above will now be described.

In FIG. 4, when the operating air chamber 62 is opened to the atmosphere through the air feeding and discharging hole 27, the outer surface 24*c* of the rubber sleeve 24 is also opened to the atmosphere. Thus, in this state, the rubber sleeve 24 maintains its original shape without being deformed. This state is referred to as "the pinch valve unit is in the opened state".

In FIG. 2, when compressed air of about 1.5–3.0 kgf/cm$^2$ is fed to the operating air chamber 62 through the air feeding and discharging hole 27, the rubber sleeve 24 is deformed as it is inwardly curved under the pressure difference. At this time, the inner surface 24*b* contacts itself at its middle region by about 50–80% of the area of the cylindrical portion. This state is referred to as "the pinch valve unit is in the closed state". By adjusting the pressure in the operating air chamber 62 through the air feeding and discharging hole 27 in this manner, the pinch valve unit can be easily operated to its opened or closed state.

By the term "normal washing operation" is meant the state in which even if there are 2–3 or more bends in the pipeline or the like to produce an increased or indefinite slide resistance between the high pressure hose and the inner surface of the pipeline, the nozzle unit can be advanced or retracted smoothly at a fixed speed and with a fixed amount of thrust along the bends in the pipeline. This state is realized by the torque adjusting function of the torque limiter unit provided in the autofeeder unit 5. That is, in FIG. 5, as the nut 49 is turned in the tightening direction, the opposite ends surfaces of the feed roller 16 are clamped by the friction plates 46 through the disc spring 48, plate 47 and single-flanged boss 44. Reversely, as the nut 49 is turned in the loosening direction, the opposite end surfaces of the feed roller 16 are loosened. In the case where the torque value needed to turn the feed roller 16 becomes greater than the friction torque value between the feed roller 16 and the friction plates 46, a slippage takes place between the two and between the bushing 16*a* and the single-flanged boss 44. By adjusting the clamping force produced by the friction plates on the feed roller 16 by means of the nut 49 through the disc spring 48 in this manner, the torque adjustment of the feed roller 16, or the thrust adjustment of the high pressure hose is effected.

During the "normal washing operation", the hose thrust is experimentally adjusted to a torque value of 3 kgf–7 kgf, and this is referred to as "steady-state set thrust". In the case where a hose thrust greater than that obtained during the "normal washing operation" is produced, for example, in the case where the position of the stopper ring 18 for positioning the detecting ring 17 is set to provide a length which is greater than the required length for washing, with the result that the nozzle unit 15 strikes the wall surface of the upstream machine 12A or the downstream machine 12B to become unable to move any further, or where the pipeline clogs somewhere with a material being transported and the nozzle unit becomes unable to move, such operation is referred to as the "unsteady-state washing operation". During the "unsteady-state washing operation", a slippage takes place between the feed roller 16 and the friction plates 46 and between the bushing 16*a* and the single-flanged boss 44, as described above. The hose thrust at which this slippage takes place is referred to as the "unsteady-state set thrust". In this case also, since the thrust between the high pressure hose 6 and the groove 61 can be set at a value (which is referred to as the maximum set thrust") greater than the "unsteady-state set thrust" by shaping and sizing the feed roller 16 as shown in FIG. 9, the slippage between the high pressure hose 6 and the groove 61 can be avoided. The thrust in this case is adjusted experimentally to a value corresponding to a hose thrust of 6–14 kgf. Usually, adjustments are made so that the following relation exists amoung the "steady-state set thrust" F1 which is the hose corresponding thrust during the "normal washing operation", the "unsteady-state set thrust" F2 which is the hose corresponding thrust during the "unsteady-state washing operation", and the "maximum set thrust" F3 which is the hose corresponding thrust between the feed roller 16 and the high pressure hose 6.

$$F1 \leqq F2(=3-7\ \text{kgf}) < F3(=6-14\ \text{kgf}) \quad \text{(Eq. 1)}$$

This means that the "normal washing operation" is performed within the range of "steady-state set thrust" F1, with the motor torque synchronously correctly transmitted to the high pressure hose 6 without slippage. And at the time of occurrence of a trouble, that is, a slippage takes place between the torque limiter unit and the feed roller 16, the torque of the motor 52 stops being correctly transmitted to the high pressure hose 6. In such case, since the high pressure hose 6 instantly stops, damage can be prevented. Further, control combined with an origin position detecting unit makes it possible to produce an emergency sound or effect abnormality treatment. Further, the aforesaid relation indicates that a slippage does not generally take place between the high pressure hose 6 and the feed roller 16.

As shown in FIG. 2, the state in which the pinch valve unit 4 is closed with the nozzle unit 15 retracted is referred to as "the high pressure hose is at the origin position". In this state, when the washing fluid, such as high temperature high pressure water, is fed to the high pressure hose 6 from the pump unit 9 successively through the high pressure water feed pipe 9*a*, rotary joint (not shown), and hose reel unit 7, the nozzle unit 15 joined to the front end of the high pressure hose 6 spouts the washing fluid through the spout holes 15*a* and 15*b* to wash the inner surface 19*f* of the boss 19*d* while rotating. The waste water is discharged outside the apparatus through the discharge hole 21.

Then, as shown in FIG. 4, after the pinch valve unit 4 is switched from the closed to the opened state (as by a solenoid valve), the upper and lower feed rollers 16 are driven in the direction of advance rotation by the motor 52 of the autofeeder unit 5, whereby the high pressure hose 6 enters the pipeline through the pinch valve unit 4 to wash the inner surface of the pipeline while moving in the advance direction. When the detecting ring 14 advances to an area outside the range of the proximity switch 20, the origin position detecting unit considers that the high pressure hose 6 is advancing away from the origin.

As the high pressure hose 6 advances, as shown in FIG. 3, the detecting ring 17 goes into the working range of the proximity switch. The detecting ring 17 is held in a position adjusted to the required washing distance by the stopper ring 18. This state is referred to as "the high pressure hose is in the advance terminal position". This state indicates that the washing operation proceeds with the high pressure hose 6 having advanced over the distance adjusted to the required washing length, and the advance terminal position detecting unit considers it to be at the advance terminal, sending a signal to the control panel 8 to stop the motor 52 of the autofeeder unit 5. Thereafter, the feeding of the high pressure hose 6 is stopped for a time required for washing the upstream machine 12B or the downstream machine 12B, and then the upper and lower feed rollers 16 are driven for rotation in the direction of retraction by the motor 52 of the autofeeder unit 5, whereby the high pressure hose 6 washes the inner surface of the pipeline as it is retracting. When the detecting ring 17 is retracted outside the working range of the proximity switch 35, the advance terminal position detecting unit considers that the high pressure hose 6 is retracting. As the high pressure hose 6 continues retraction, the detecting ring 14 goes into the working range of the proximity switch 35, and the origin position detecting unit considers it to be at the origin, stopping the motor 52 of the autofeeder unit 5. At the end of the washing operation, as shown in FIG. 2, the nozzle unit 15 is at the origin position, and concurrently the pinch valve unit 4 is closed. Therefore, the washing unit is in the state of being completely separated from the pipeline. This is "the washing 1 cycle" of each of washing units A and B during "the normal washing operation". Each of the washing units A and B selectively performs this "washing 1 cycle" to wash the pipeline including the upstream machine 12B and downstream machine 12A. That is, in FIG. 1, by operating the washing unit A with the pinch valve unit 4*b* closed and with the washing unit B separated from the pipeline C, the upstream machine 12B and the pipe region extending to the upstream machine 12B can be washed. Reversely, by operating the washing unit B with the pinch valve unit 4*a* closed and with the washing unit A separated from the pipeline C, the downstream machine 12A and the pipe region extending to the downstream machine 12A can be washed. The number of repetitions of "the washing 1 cycle" is programed using such factors as the configurations of the pipeline, which is an object to be washed, (such as (1) the properties of the material to be transported, (2) the length of the pipeline, (3) the number of bends, (4) the inner diameter of the pipeline), the washing cycle, (such as (1) primary washing (using a detergent) with tap water, (2) finish washing using deionized water or distilled water, (3) hot air drying time), washing conditions (such as (1) washing pressure, (2) washing temperature, and it is effected by sequential control.

These above-mentioned operations are organically connected with respect to the pair of washing units A and B connected to the pipeline C.

Figure 10:
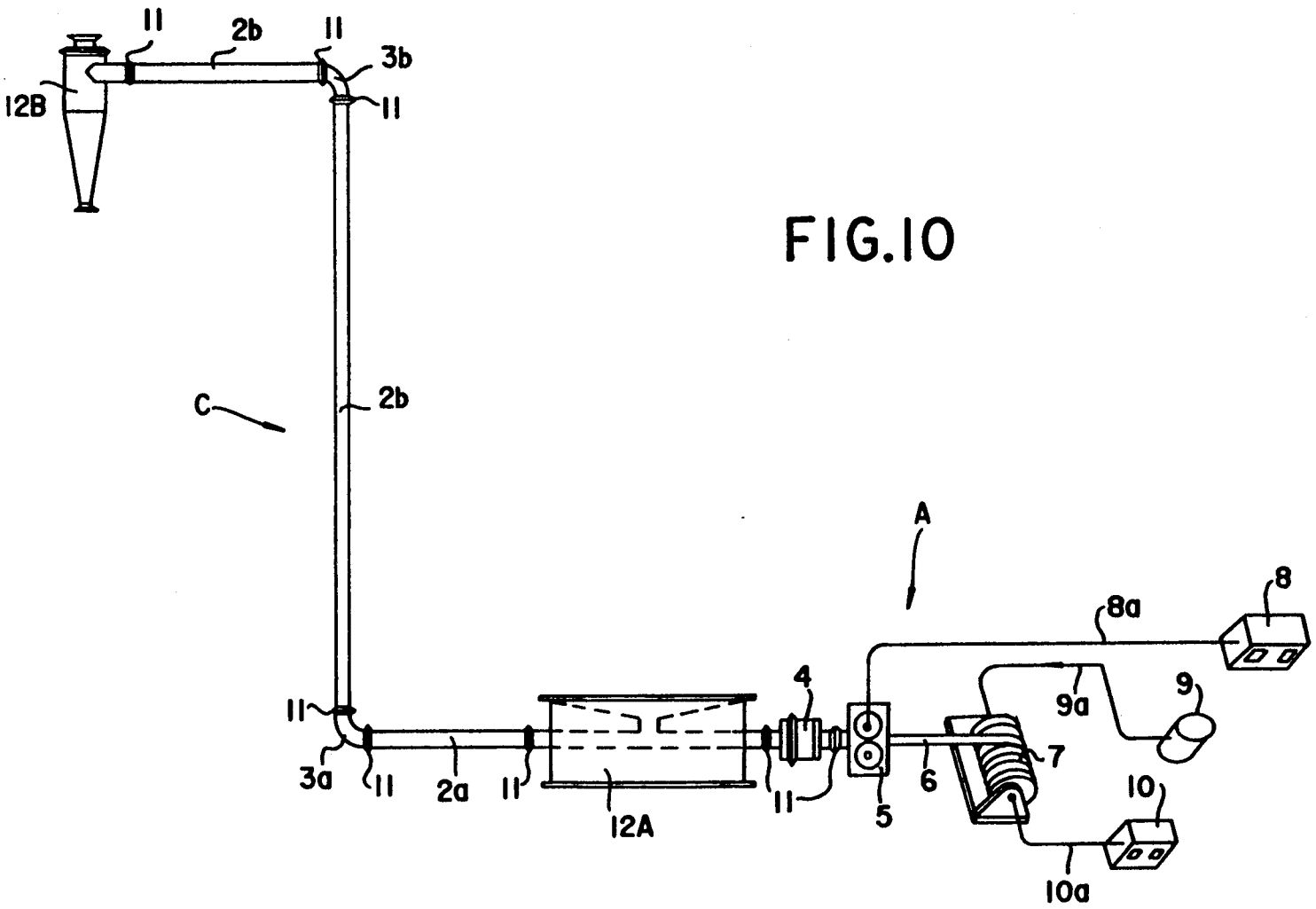
FIG. 10 is a view showing the entire arrangement of the automatic washing apparatus according to the invention.

In addition, the present invention is not limited to the above embodiment. For example, as shown in FIG. 10, in the case where there is no problem in mechanism even if the pipeline C is disposed to extend through the downstream machine 12A, the upstream machine 12B, the pipeline C and the downstream machine 12A can be washed in the same manner as described above if the one washing unit is connected to the portion of the pipeline which is further downstream of the downstream machine 12A. Therefore, installation of a single washing unit provides the same washing operation and the same effects as provided by a pair of washing units; thus, an inexpensive washing system can be constructed.

Figure 11:
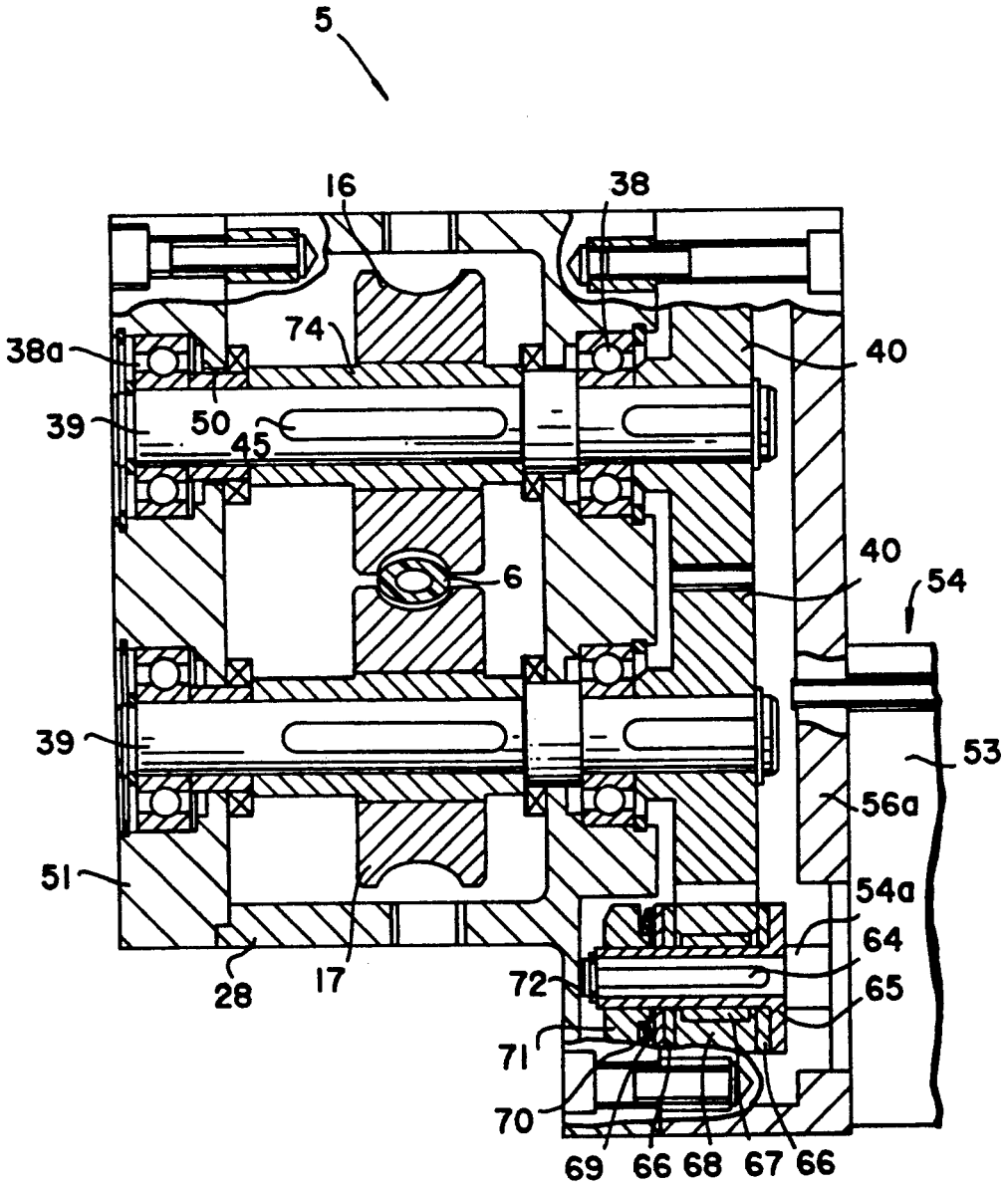
FIG. 11 is a sectional view showing another embodiment of an autofeeder unit.

The torque limiters in FIG. 5 disposed on the upper and lower feed roller drive shafts 39 may be replaced by a single torque limiter shown in FIG. 11 disposed on the output shaft 54*a* of the drive motor 54, with the feed roller fixed on the roller shaft 74 for integration. In the same figure, the single-flanged boss 65 mounted on the output shaft 54*a* is keyed as at 64 and fixed in position by a snap ring 72. And a friction plate 66, a pinion 68 with a bushing 67 and a friction plate 66 are mounted on the outer surface of the single-flanged boss in the predetermined order and fixed in position by a nut 71 threadedly engaged with the threaded portion of the single-flanged boss 65. The integrated feed roller 16 and roller shaft 74 are disposed in intimate contact with the step portion 39*a* of the feed roller drive shaft 39 and the collar 50 and fixed in position by the key 45. As a result of such arrangement, the aforesaid relation of (Eq. 1) becomes as follows:

$$F1 \leqq F2(=1.5-3.5\ \text{kgf}) < F3(=6-7\ \text{kgf}) \quad \text{(Eq. 2)}$$

This means that only one torque limiter having half the torque transmission capacity is sufficient, reducing the cost. In addition, the details of which a description has been omitted in the same figure are substantially the same as in FIG. 5.

Further, the optimum washing conditions for a material to be washed can be obtained by changing the shape and size and the number and spout angle of the spout holes 15*a* in the nozzle unit 15.

What is claimed is:

1. An automatic inner pipeline surface washing apparatus comprising:

an openable and closable pinch valve unit connected branchwise to a pipeline to be washed;

a rotatable nozzle unit for spouting a washing fluid rearwardly and circumferentially while rotating;

a washing hose having said nozzle unit connected to a front end thereof; and an autofeeder unit operatively connected to said washing hose so as to control advance and retraction movement of said washing hose with a predetermined thrust and at a predetermined speed, wherein during a washing operation said nozzle unit enters the pipeline through said pinch valve unit now opened to wash an inner surface of the pipeline by spouting the washing fluid fed through said washing hose and during nonwashing period said nozzle is retracted and completely isolated from the pipeline by said pinch valve unit now closed.

2. An automatic inner pipeline surface washing apparatus as set forth in claim 1, further comprising:

a limiter unit for controlling the thrust of said washing hose installed on said autofeeder unit.

3. An automatic inner pipeline surface washing apparatus as set forth in claim 1, further comprising:

a detecting unit for detecting an advance start position and advance terminal position of said washing hose, wherein a signal outputted by said detecting unit is fed to said autofeeder unit which automatically controls the feed of said washing hose, whereby the advance and retraction of said washing hose are automatically controlled.

4. An automatic inner pipeline surface washing apparatus as set forth in claim 1, 2, or 3, further comprising:

a hose reel unit controlled for forward and reverse variable speed rotation to wind and unwind said washing hose, said hose reel unit being connected to washing fluid feeding means, the washing fluid being fed to said washing hose through said hose reel unit.

* * * * *